US005092396A

United States Patent [19]

Murano et al.

[11] Patent Number: 5,092,396

[45] Date of Patent: Mar. 3, 1992

[54] AIR-CONDITIONING SYSTEM

[75] Inventors: Mitsuo Murano; Keiichi Morita, both of Fujinomiya; Akihiko Sugiyama, Fuji, all of Japan

[73] Assignee: Kabushiki Kaisha Toshiba, Kawasaki, Japan

[21] Appl. No.: 636,244

[22] Filed: Dec. 31, 1990

[30] Foreign Application Priority Data

Feb. 14, 1990 [JP] Japan ..... 2-32693

[51] Int. Cl.[5] ..... F28F 19/00

[52] U.S. Cl. ..... 165/119; 62/78; 55/269; 403/345

[58] Field of Search ..... 62/78, 263; 248/221.4; 165/119; 55/269; 403/345

[56] References Cited

U.S. PATENT DOCUMENTS

| | | | |
|---|---|---|---|
| 2,868,489 | 1/1959 | Calcut | 248/221.4 |
| 3,536,281 | 10/1970 | Meehan et al. | 248/221.4 X |
| 4,537,821 | 8/1985 | Fast | 248/221.4 X |
| 4,813,642 | 3/1989 | Matsui | 248/221.4 X |
| 4,997,147 | 3/1991 | Velke, Sr. et al. | 248/221.4 X |

FOREIGN PATENT DOCUMENTS

| | | |
|---|---|---|
| 1-210045 | 8/1989 | Japan . |
| 2-10045 | 1/1990 | Japan . |

*Primary Examiner*—William E. Tapolcai

*Attorney, Agent, or Firm*—Cushman, Darby & Cushman

[57] ABSTRACT

An indoor unit of an air-conditioning system is provided with a heat exchanger, a fan, and an air cleaner. The fan introduces the air in a room into the indoor unit, and blows the air back into the room after guiding the air to pass through both the heat exchanger and the air cleaner. The heat exchanger performs heat exchange with reference to the air circulated by the fan, for air-cooling, heating, or dehumidification. The air cleaner is arranged in front of the heat exchanger, with a predetermined gap maintained with reference to the heat exchanger. The air cleaner catches dust particles in the air and eliminates odorants from the air. The air cleaner is provided with engaging members. These engaging members are projected from the air cleaner and engage with the heat exchanger. Accordingly, the air cleaner is prevented from swinging, and the gap between the air cleaner and the heat exchanger is maintained at a constant value.

10 Claims, 3 Drawing Sheets

AIR-CONDITIONING SYSTEM

BACKGROUND OF THE INVENTION

1. Field of the Invention

The present invention relates to an air-conditioning system which performs air-conditioning, such as air-cooling, heating and dehumidification, and which is provided with an air cleaner capable of eliminating the dust and odorants from the air.

2. Description of the Related Art

An air-conditioning system performs air conditioning (such as air-cooling, heating and dehumidification) by drawing the air of a room into the heat exchanger of its indoor unit and performing heat exchange with respect to the drawn air.

An air-conditioning system recently developed is provided with an air cleaner which removes fine dust particles and odorants from the air circulated by the air-conditioning system. In this type of air-conditioning system, the air cleaner is made up of an electric dust-collecting device and an odorant filter device, and is arranged in front of the heat exchanger. The electric dust-collecting device includes a plurality of ionization wires connected to the positive terminal of a high d.c. voltage source. It also includes an electrode body having a plurality of electrode plates facing the ionization wires. The odorant filter device contains an activated carbon filter.

In general, it is desirable that the indoor unit of an air-conditioning system be installed on a wall portion close to the ceiling since the indoor unit installed at such a wall portion allows the floor space to be used effectively. It is also desirable that the indoor unit be as flat as possible since such a flat indoor unit does not give a feeling of oppression to the user.

Since the indoor unit installed on a wall portion close to the ceiling is limited in its vertical dimension, the heat exchanger incorporated in the indoor unit is also limited in its vertical dimension. Therefore, the heat exchanger is elongated in the widthwise direction of the indoor unit, so as to ensure a sufficiently wide heat exchange area. Accordingly, both the heat exchanger and the main body of the indoor unit are short in the vertical direction and are long in the horizontal direction.

If the air cleaner arranged in front of the heat exchanger has the same shape as the heat exchanger, it causes air resistance with reference to the heat exchanger. Because of this air resistance, the pressure loss of the air flowing into the heat exchanger increases, resulting in deterioration in the heat exchange efficiency of the air-conditioning system.

To solve this problem, the shape of the conventional air cleaner is determined in such a manner that its horizontal dimension is equal to that of the heat exchanger but its vertical dimension is half that of the heat exchanger. That is, the air cleaner is very long in the horizontal direction. If an air cleaner has such a shape, it does not cause much air resistance with reference to the heat exchanger. Thus, necessary heat exchange efficiency is ensured for the heat exchanger, and sufficient air cleaning efficiency is ensured for the air cleaner. The heat exchanger is fixed inside the main body of the indoor unit and has plates at the ends thereof. Both ends of the air cleaner are attached to the respective plates of the heat exchanger.

Although the air cleaner is very long, it is fixed only at the longitudinal ends. In other words, no support means is provided at an intermediate point of the air cleaner.

An air-conditioning system is transported after it is manufactured in a factory. During the transportation, vibration is applied to the air-conditioning system not only in the vertical direction thereof but also in the horizontal and diagonal directions. Since the air cleaner is fixed only at ends, as mentioned above, it bends during the transportation. In particular, its central portion greatly bends during the transportation. Due to this bending, the air cleaner may be damaged during the transportation. In the worst case, the air cleaner may be broken, or the portion for supporting the ionization wires of the electric dust-collection device may be deformed, resulting in disconnection of the ionization wires.

One measure for preventing this problem is to employ thick (therefore rigid) ionization wires. However, if thick ionization wires are used, the manufacturing cost of the air-conditioning system is increased, and the total weight of the air-conditioning system is also increased.

Another measure for preventing the problem is disclosed in Published Unexamined Japanese Patent Application No. 1-210045. According to this reference, a unit frame is provided with batten ribs, and these batten ribs are in contact with the heat exchanger. Due to the provision of the batten ribs, the distance between the unit frame and the heat exchanger is always maintained at a constant value. The distance remains unchanged even if the unit frame is pressed against the heat exchanger by an external force.

However, the vibration during the transportation does not always act in such a direction that the air cleaner is pressed against the heat exchanger. The heat cleaner is not only vibrated back and forth but also vibrated in the vertical and diagonal directions. The batten ribs may prevent the unit frame from touching the heat exchanger, but cannot suppress the vibration occurring in the other directions. Therefore, it is possible that the air cleaner will be deformed as a result of the vibration.

SUMMARY OF THE INVENTION

The present invention has been developed in consideration of the above problems of the prior art, and an object of the invention is to provide an air-conditioning system which is of a type incorporating an air cleaner, which prevents the air cleaner from swinging and maintains the distance between the air cleaner and the heat exchanger at a constant value even if vibration acts in any direction during transportation, and which therefore prevents the air cleaner from being damaged or deformed during the transportation.

To achieve this object, the present invention provides an air-conditioning system which comprises:

an indoor unit which is to be arranged in a room to be air-conditioned, and which includes a heat exchanger, and circulating means for causing the air in the room to be circulated through the heat exchanger;

an air cleaner, incorporated in the indoor unit, for eliminating dust and odorants from the air, the air cleaner being arranged in front of the heat exchanger, with a predetermined gap provided with reference to the heat exchanger; and engaging means, projected from the air cleaner and engaging with the heat exchanger, for preventing the air cleaner from vibrating and for maintaining the predetermined gap between the heat exchanger and the air cleaner.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 1 through 5 illustrate an air-conditioning system, incorporating an air cleaner, according to one embodiment of the present invention, of which:

FIG. 1 is a front view of an indoor unit of the air-conditioning system;

FIG. 2 is a front view of the indoor unit whose front panel is open;

FIG. 3 is a cross sectional view of the indoor unit;

FIG. 4 is a front view which shows indoor door unit but omits illustration of the casing thereof; and FIG. 5 is a cross sectional view in which the heat exchanger and the air cleaner are partly depicted in an enlarged scale.

DETAILED DESCRIPTION OF THE PREFERRED EMBODIMENT

One embodiment of the present invention will now be described, with reference to the accompanying drawings.

Figure 1:
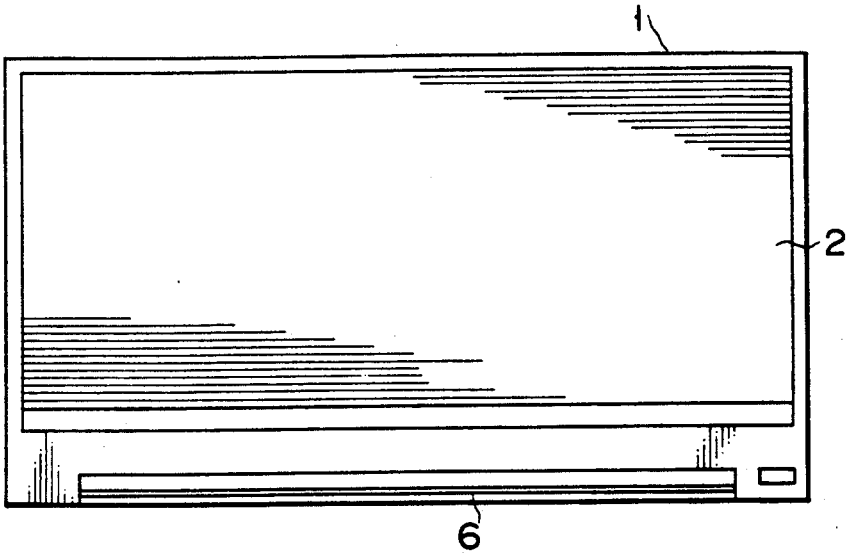
Figure 2:
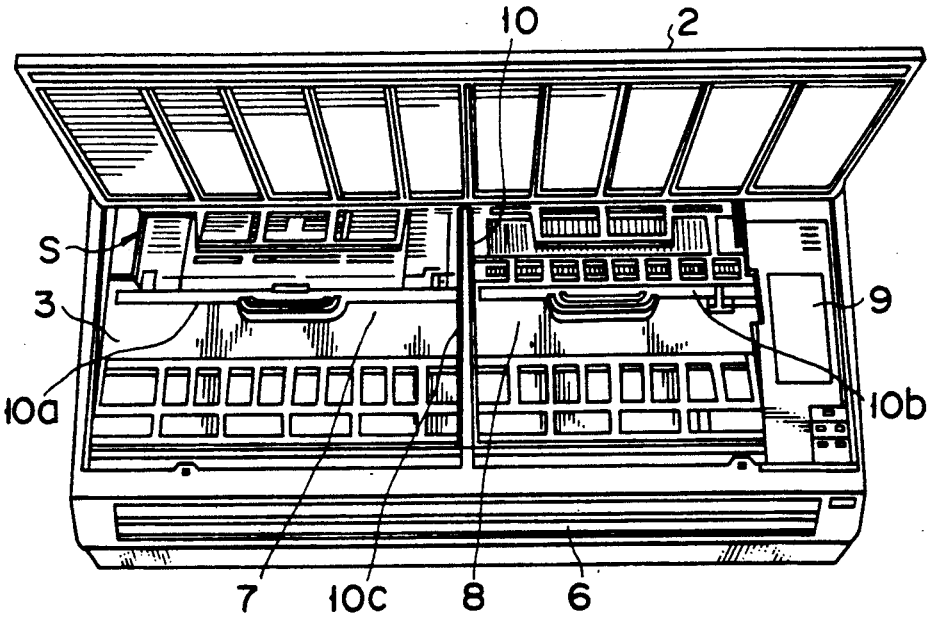
Figure 3:
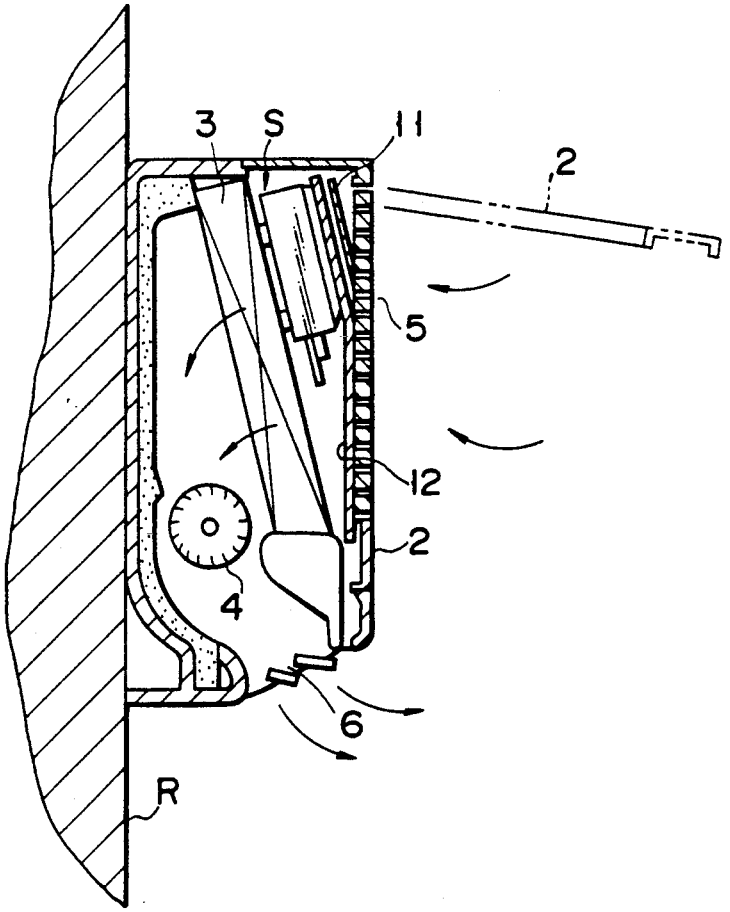

FIG. 1 is a front view of the indoor unit of an air-conditioning system (which is of a type incorporating an air cleaner) according to one embodiment of the present invention, and FIGS. 2 and 3 individually show the internal structure of the indoor unit.

The indoor unit comprises a rectangular box-like casing 1, and is installed on a wall R of a room to be air conditioned. A heat exchanger 3, an air-sending fan 4, and an air cleaner S, and other structural components are arranged inside the casing 1. The casing 1 is provided with a front panel 2. This front panel 2 can be opened or closed with reference to the casing 1, with the uppermost portion as a center. When the front panel 2 is open (or when it is moved up to the position indicated by the two-dot-dash lines in FIG. 3), the interior of the casing 1 is exposed, as is shown in FIG. 2.

As is best understood in FIG. 3, the heat exchanger 3 inside the casing 1 is slanted with reference to a vertical plane such that the upper edge is closer to the rear wall of the casing 1 than the lower edge.

The air-sending fan 4 is located under the rear wall of the heat exchanger 3. When this fan 4 is driven, the air in the room is circulated in the manner indicated by the arrows in FIG. 3. More specifically, the air is drawn into the casing through air inlet ports 5 formed in the front panel 2, and passes through the heat exchanger 3, for heat exchange. Thereafter, the air is blown into the room through air outlet ports 6 located below the front panel 2.

The casing 1 is formed to be as flat as possible, and is more elongated in the horizontal direction than in the vertical direction. Likewise, the heat exchanger 3 fixed inside the casing 1 is formed to be as flat as possible, and is more elongated in the horizontal direction than in the vertical direction.

The air cleaner S is located in front of the heat exchanger 3 (i.e., in the air inlet region). It is made up of an electric dust-collecting device 7, an odorant filter device 8, and a controller 9.

The casing 1 is provided with a main frame 10 having a left-side frame portion **10*a* and a right-side frame portion 10*b*. Normally, the electric dust-collecting device 7 is arranged in the left-side frame portion 10*a*, and the odorant filter device 8 is arranged in the right-side frame portion 10*b***. However, they may be arranged in the opposite manner, if so desired.

The electric dust-collecting device 7 and the odorant filter device 8 are slanted in parallel to the heat exchanger 3, with their upper edges being substantially at the same level as the upper edge of the heat exchanger 3. They are spaced away from the heat exchanger 3 by a predetermined distance.

The electric dust-collecting device 7 and odorant filter device 8 have vertical dimensions which are about half that of the heat exchanger 3. Instead, they are elongated in the horizontal direction.

As can be understood from FIG. 2, which shows the state where the front panel 2 is open, the upper half of the heat exchanger 3 is covered with the electric dust-collecting device 7 and odorant filter device 8, whereas the lower half thereof is uncovered.

The controller 9 controls not only the electric dust-collecting device 7 but also the entire operation of the air-conditioning system.

A filter guide 11 is located in front of the air cleaner S. Being guided by this filter guide 11, an air filter 12 is inserted into the region behind the air inlet ports 5 of the front panel 2 or is removed from that region.

Figure 5:
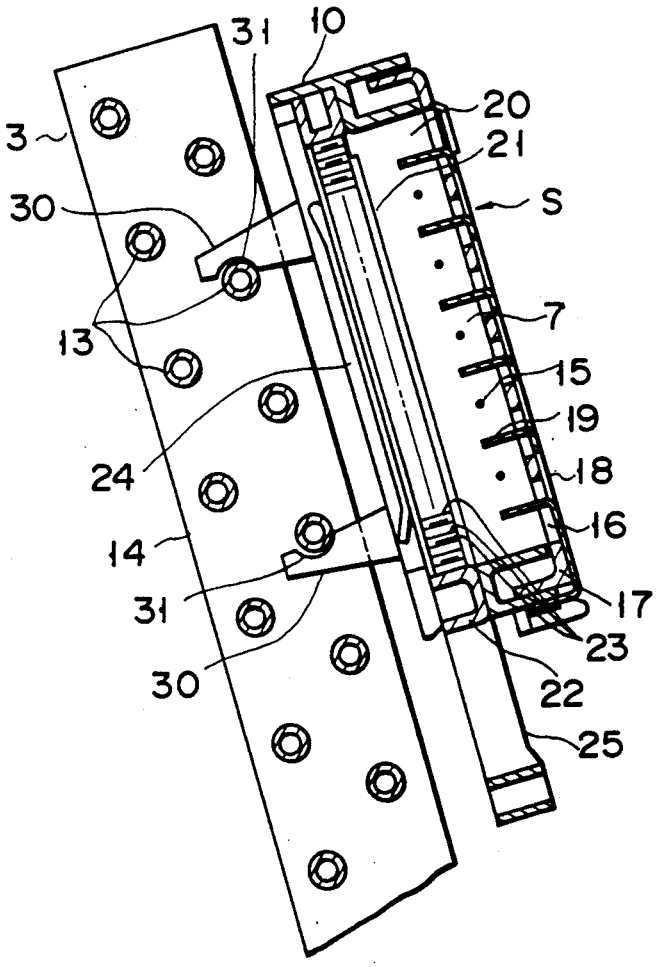

As is shown in FIG. 5, the heat exchanger 3 comprises a heat-exchanging pipe 13 and a large number of fins 14. The heat-exchanging pipe 13 is bent and arranged in such a manner as to have a front-row section and a rear-row section. In each section, the adjacent portions of the heat-exchanging pipe 13 are spaced from each other by a predetermined distance. The pipe portions of the front-row section do not oppose the corresponding pipe portions of the rear-row section; they are shifted from the corresponding ones in the vertical direction. The fins 14 are very thin and are arranged in the axial direction of the heat-exchanging pipe 13 at very short intervals.

The electric dust-collecting device 7 is made up of an ionization section 20 and a dust collection section 21.

In the ionization section 20, one ionization wire 15 is arranged in a zigzag pattern. Both ends of this ionization wire 15 are electrically insulated. A frame 17 having slits 16 is arranged such that the slits 16 correspond in location to the regions between the adjacent turns of the ionization wire 15. A facing plate 18, which is grounded, is removably attached to the frame 17. The facing plate 18 is formed by a metal plate, such as a stainless steel plate, and is partly cut and raised such that the raised portions constitute electrode plates 19 inserted into the slits 16 of the frame 17. Each turn of the ionization wire 15 passes through the region defined between the electrode plates 19.

The dust collection section 21 is located on the rear side of the ionization section 20. The dust collection section 21 includes a rectangular frame body 22, and a large number of belt-like synthetic resin sheets 23 which are stacked upon each other at a predetermined pitch and held in the frame body 22. A conductive layer (e.g., a coating of conductive paint) is formed on one side of each synthetic resin sheet 23, and is electrically connected to an electrode (not shown). The frame body 22 is pressed against, and is supported by a collector support 24 arranged in the left-side frame portion 10*a* of the main frame 10. The frame body 22 has a handle 25 integrally extending from the lower portion thereof. This handle 25 is projected downward from the lower face of the main frame 10. The dust collection section 21 can be easily removed from the electric dust-collecting device 7 by pulling it down with the handle 25, and can be easily inserted into the predetermined region inside the electric dust-collecting device 7 by raising it with the handle 25.

Figure 4:
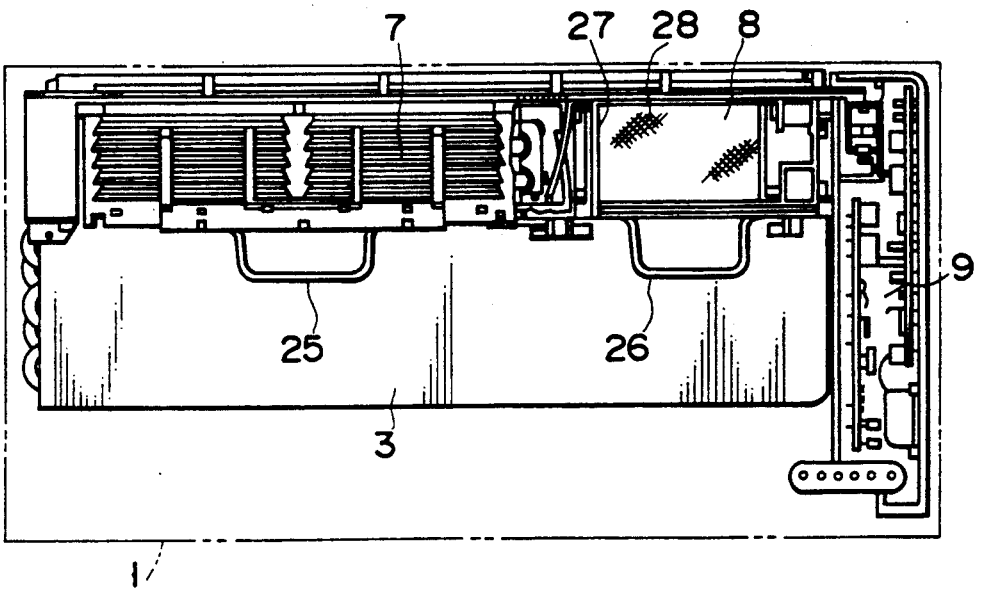

As is shown in FIGS. 2 and 4, the odorant filter device 8 is located between the electric dust-collecting device 7 and the controller 9. The odorant filter device 8 comprises a handle 26 which is integral with the lower portion of the device 8, and a case 27 which is removably by set in the right-side frame portion 10*b* of the main frame 10. The case 27 contains an odorant-removing filter 28, e.g., an activated carbon filter.

A pair of engaging pieces 30 are projected from the horizontal center of the rear face of the air cleaner S mentioned above. In other words, the position of the engaging pieces 30 corresponds to that of a main frame's central portion 10*c* (FIG. 2), on both sides of which the electric dust-collecting device 7 and the odorant filter device 8 are arranged.

As is shown in FIG. 5, the engaging pieces 30 are spaced apart in the vertical direction and aligned with each other. The thickness of each engaging piece 30 is smaller than the interval between the fins 14 of the heat exchanger 3. The vertical dimension of each engaging piece 30 is decreased from the proximal portion to the distal end portion thereof, and has a substantially triangular shape.

The engaging pieces 30 each have a semi-circular cutaway section 31 whose radius is substantially equal to that of the heat-exchanging pipe 13 of the heat exchanger 3. The cutaway section 31 of the upper engaging piece 30 is formed on the lower portion thereof, while the cutaway section 31 of the lower engaging piece 30 is formed on the upper portion thereof. In short, the cutaway section 31 of one engaging piece 30 faces that of the other. The distance between the engaging pieces 31 is substantially equal to the distance between the predetermined turns of the heat-exchanging pipe 13. Each engaging piece 30 is projected from the rear face of the air cleaner S, and the distal end thereof is inserted between the adjacent fins 14 of the heat exchanger 3.

The cutaway section 31 of each engaging piece 30 is fitted around one turn of the heat-exchanging pipe 13. In this state, the paired engaging pieces 30 engage with the heat-exchanging pipe 30 and clasps the predetermined turns of the pipe 30 from above and from below.

In the manner mentioned above, the air cleaner S is fixed to the heat exchanger 3 by means of the engaging pieces 30. With this structure, the air cleaner S is prevented from swinging not only in the vertical direction but also in the other directions. In addition, the gap between the rear face of the air cleaner S and the front face of the heat exchanger 3 is maintained at a constant value by the engaging pieces 30.

A description will now be given of the operation of the above-mentioned air-conditioning system.

Part of the air in a room is introduced into the air-conditioning system through the air inlet ports 5. The introduced air passes through the air filter 12, by which comparatively large dust particles are removed from the air.

Part of the introduced air passes through either the electric dust-collecting device 7 or the odorant filter device 8 before it reaches the heat exchanger 3. When passing through the electric dust-collecting device 7, fine dust particles included in the air are ionized because of the electric discharge caused by the ionization wire 15, and are therefore caught by the dust collection section 21. When passing through the odorant filter device 8, the air is cleared of odorants. Accordingly, the air is cleaned by the electric dust-collecting device 7 and the odorant filter device 8.

Next, the air passes through the heat exchanger 3, where heat exchange is performed with respect to the air. After this heat exchange, the air is blown into the room through the air outlet ports 6 of the casing 1.

Like the conventional air-conditioning system, the air-conditioning system of the above embodiment is subjected to vibration when it is transported. Since the air cleaner S of the air-conditioning system is elongated in the horizontal direction, as in the conventional system, its central portion is subjected to the vibration intensively. However, the central portion of the air cleaner S is fixed to the heat-exchanging pipe 13 by means of the engaging pieces 30. With this structure, the air cleaner S is prevented from swinging in the vertical, horizontal, and diagonal directions.

Since the air cleaner S is reliably prevented from swinging, it is not deformed during transportation. In addition, the ionization wire 15 of the electric dust-collecting device 7 is prevented from breaking since it is not exerted with an excessive force. Thus, the function of the air cleaner S is not adversely affected during transportation.

Moreover, the engaging pieces 30 maintains a predetermined gap between the air cleaner S and the heat exchanger 3. The heat exchanger generates water as a result of the heat exchange operation, but such water is drained through the gap and does not enter the air cleaner S. Therefore, the dust-collecting efficiency and the insulated state of the air cleaner are in no way adversely affected by the water generated by the heat exchanger.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An air-conditioning system comprising:

an indoor unit adapted to be arranged in a room to be air-conditioned, the indoor unit including a heat exchanger having at least one heat-exchanging pipe, and circulating means for causing the air in the room to be circulated through the heat exchanger;

an air cleaner, incorporated in the indoor unit, for eliminating dust and odorants from the air, the air cleaner being arranged in front of the heat exchanger, with a predetermined gap provided with reference to the heat exchanger; and clasping means, projecting from the air cleaner, for securing the air cleaner to the least one heat-exchanging pipe to substantially prevent the air cleaner from vibrating and to substantially maintain the predetermined gap between the heat exchanger and the air cleaner.

2. An air-conditioning system according to claim 1, wherein said indoor unit includes:

a front panel having air inlet ports; and a casing having air outlet ports and containing the air cleaner and the heat exchanger.

3. An air-conditioning system according to claim 2, wherein said circulating means includes a fan contained in the casing, said fan introducing the air into the casing through the air inlet ports, and blowing the air into the room after guiding the air through the air cleaner and the heat exchanger.

4. An air-conditioning system according to claim 1, wherein the heat exchanger is a fin-and-tube type further comprising:

a plurality of fins arranged at predetermined intervals and through which the at least one heat-exchanging pipe extends.

5. An air-conditioning system according to claim 1, wherein said air cleaner includes:

an electric dust-collecting section for catching dust particles included in the air; and an odorant filter section for eliminating odorants from the air, said electric dust-collecting section and said odorant filter section being arranges side by side in the same plane.

6. An air-conditioning system according to claim 5, wherein said electric dust-collecting section includes:

ionization means for ionizing fine dust particles included in the air; and a collector for catching the fine dust particles ionized by the ionization means.

7. An air-conditioning system according to claim 1, wherein said air cleaner has a vertical dimension which is substantially half that of the heat exchanger, and a horizontal dimension which is substantially equal to that of the heat exchanger.

8. An air-conditioning system according to claim 1, wherein said engaging means is projected from a central portion of the air cleaner and engages with a central portion of the heat exchanger.

9. An air-conditioning system according to claim 1, wherein the clasping means comprises a pair of projected members located in a central portion of the air-conditioning system and vertically spaced apart from each other to be opposite to each other, each of the projected members including a distal end portion for securing to the at least one heat-exchanging pipe.

10. An air-conditioning system comprising:

an indoor unit which is to be arranged in a room to be air-conditioned, said indoor unit including: (a) a fin-and-tube type heat exchanger that is made up of a heat-exchanging pipe, and a plurality of fins which are arranged at predetermined intervals and through which the heat-exchanging pipe extends; and (b) circulating means for causing the air in the room to be circulated through the heat exchanger;

an air cleaner incorporated in the indoor unit and arranged in front of the heat exchanger, with a predetermined gap provided with reference to the heat exchanger, said air cleaner including: (a) an electric dust-collecting section for catching dust particles included in the air; and (b) an odorant filter section for eliminating odorants from the air, said electric dust-collecting section and said odorant filter section being arranged side by side in the same plane; and engaging means, projected from the air cleaner, for engaging with the heat exchanger, said engaging means including a pair of projected members located in a central portion of the air cleaner and vertically spaced apart from each other in such a manner as to opposite each other, each of said projected members including a distal end portion engageable with the heat exchanger.

* * * * *